US008733452B2

(12) United States Patent
Guesnon et al.

(10) Patent No.: US 8,733,452 B2
(45) Date of Patent: May 27, 2014

(54) RISER SECTION CONNECTOR WITH FLANGES AND EXTERNAL LOCKING RING

(75) Inventors: Jean Guesnon, Chatou (FR); Gerard Papon, Les Essarts le Roi (FR); Emmanuel Persent, Croissy sur Seine (FR); Oystein Luktvasslimo, Oslo (NO); Jaan Anderson, Rykkin (NO); Bjorn Paulshus, Kjeller (NO)

(73) Assignees: IFP Energies Nouvelles, Rueil-Malmaison (FR); Aker Subsea AS, Fornebu (NO)

( * ) Notice: Subject to any disclaimer, the term of this patent is extended or adjusted under 35 U.S.C. 154(b) by 0 days.

(21) Appl. No.: 13/580,670

(22) PCT Filed: Feb. 11, 2011

(86) PCT No.: PCT/IB2011/000482

§ 371 (c)(1),
(2), (4) Date: Jun. 19, 2013

(87) PCT Pub. No.: WO2011/104629

PCT Pub. Date: Sep. 1, 2011

(65) Prior Publication Data

US 2013/0020087 A1 Jan. 24, 2013

(30) Foreign Application Priority Data

Feb. 23, 2010 (FR) ..... 10 00729

(51) Int. Cl.

| | |
|---|---|
| ***E21B 43/08*** | (2006.01) |
| ***E21B 33/076*** | (2006.01) |
| ***E21B 33/038*** | (2006.01) |
| ***E21B 33/035*** | (2006.01) |
| ***E21B 41/10*** | (2006.01) |
| ***E21B 7/128*** | (2006.01) |
| ***E21B 17/01*** | (2006.01) |

(52) U.S. Cl.

USPC ..... 166/378; 166/341; 166/344; 166/351; 166/360; 166/367

(58) Field of Classification Search

CPC ..... E21B 19/16; E21B 33/038; E21B 33/035; E21B 17/02; E21B 23/00; E21B 17/043; E21B 17/06; E21B 17/085; F16L 15/003; F16L 1/123; F16L 37/252

USPC ..... 285/391, 124.1, 124.4, 363, 364; 166/338, 341, 344, 351, 352, 360, 367, 166/378, 379, 380, 85.1

See application file for complete search history.

(56) References Cited

U.S. PATENT DOCUMENTS 3,198,555 A * 8/1965 Johnson et al. ..... 285/91
3,268,243 A * 8/1966 Word, Jr. ..... 166/368

(Continued)

FOREIGN PATENT DOCUMENTS

DE 28 33 866 A1 2/1980
FR 2 526 517 A2 11/1983

(Continued)

*Primary Examiner* — Matthew Buck
*Assistant Examiner* — Edwin Toledo-Duran
(74) *Attorney, Agent, or Firm* — Antonelli, Terry, Stout & Kraus, LLP.

(57) ABSTRACT

A connector includes a male flange and a female flange allowing to assemble a main tube and auxiliary line tubes.
A locking ring assembles the male flange and the female flange. The locking ring is mounted mobile in rotation on the outer periphery of the male flange while cooperating with the outer periphery of the male and female flanges.

14 Claims, 9 Drawing Sheets

(56) References Cited

U.S. PATENT DOCUMENTS

| | | | | |
|---|---|---|---|---|
| 3,508,609 | A * | 4/1970 | Fowler et al. | 166/351 |
| 3,727,954 | A * | 4/1973 | Oliver | 285/146.3 |
| 3,741,294 | A * | 6/1973 | Morrill | 166/367 |
| 3,741,296 | A * | 6/1973 | Murman et al. | 166/338 |
| 3,827,728 | A * | 8/1974 | Hynes | 285/90 |
| 4,043,575 | A * | 8/1977 | Roth | 285/90 |
| 4,062,571 | A * | 12/1977 | Sicard | 285/26 |
| 4,173,360 | A * | 11/1979 | Bergman et al. | 285/51 |
| 4,298,067 | A * | 11/1981 | Lawson | 166/380 |
| 4,496,173 | A | 1/1985 | Roche et al. | |
| 5,634,671 | A * | 6/1997 | Watkins | 285/18 |
| 6,070,911 | A * | 6/2000 | Namikawa et al. | 285/48 |
| 7,231,983 | B2 * | 6/2007 | Lequang et al. | 166/379 |
| 7,331,395 | B2 * | 2/2008 | Fraser et al. | 166/345 |
| 7,341,281 | B2 * | 3/2008 | Guesnon et al. | 285/81 |
| 7,487,837 | B2 * | 2/2009 | Bailey et al. | 166/345 |
| 7,568,522 | B2 * | 8/2009 | Boutwell et al. | 166/250.01 |
| 7,686,087 | B2 * | 3/2010 | Pallini et al. | 166/367 |
| 7,762,337 | B2 | 7/2010 | Papon et al. | |
| 7,896,081 | B2 * | 3/2011 | Pallini et al. | 166/345 |
| 7,963,337 | B2 * | 6/2011 | Pallini et al. | 166/367 |
| 8,037,939 | B2 | 10/2011 | Poirette et al. | |
| 8,127,853 | B2 * | 3/2012 | Pallini et al. | 166/345 |
| 8,210,265 | B2 * | 7/2012 | Alikin et al. | 166/367 |
| 8,616,286 | B2 * | 12/2013 | Papon et al. | 166/338 |
| 2007/0044973 | A1 * | 3/2007 | Fraser et al. | 166/367 |
| 2007/0205001 | A1 * | 9/2007 | Shuster et al. | 166/380 |
| 2011/0147009 | A1 * | 6/2011 | Dupal et al. | 166/380 |

FOREIGN PATENT DOCUMENTS

| | | | |
|---|---|---|---|
| FR | 2 891 577 | A1 | 4/2007 |
| FR | 2 891 578 | A1 | 4/2007 |
| FR | 2 891 579 | A1 | 4/2007 |
| WO | WO 2007039688 | A1 * | 4/2007 |

* cited by examiner

RISER SECTION CONNECTOR WITH FLANGES AND EXTERNAL LOCKING RING

FIELD OF THE INVENTION

The present invention relates to the sphere of very deep sea drilling and oil field development. It concerns a connector for assembling two riser pipe sections.

BACKGROUND OF THE INVENTION

A riser pipe is made up of an assembly of tubular elements assembled by connectors. The tubular elements generally consist of a main tube provided with a connector at each end thereof. The main tube is fitted with auxiliary lines commonly referred to as "kill line", "choke line", "booster line" and "hydraulic line", which allow circulation of a technical fluid to the well and of a formation fluid to the surface. The tubular elements are assembled on the drilling site, from a floater. The riser pipe is lowered into the water depth as the tubular elements are assembled, until the wellhead located on the sea bottom is reached.

In the perspective of drilling at water depths that can reach 3500 m or more, the weight of the riser pipe becomes very penalizing. This phenomenon is increased by the fact that, for the same maximum working pressure, the length of the riser requires a larger inside diameter for the auxiliary lines considering the necessity to limit pressure drops.

Besides, the necessity to decrease the riser pipe assembly time is all the more critical since the water depth, and therefore the riser length, are great.

Documents FR-2,891,577 (U.S. Pat. No. 7,762,337), FR-2,891,578 and FR-2,891,579 (U.S. Pat. No. 8,037,939) describe various solutions notably aiming to involve the auxiliary lines, together with the main tube, in the taking up of the longitudinal stresses undergone by the riser pipe.

The present invention describes an alternative solution providing a compact connector design well suited for deep-sea risers, i.e. located at depths greater than 2000 meters.

SUMMARY OF THE INVENTION

In general terms, the invention relates to a connector for assembling two riser pipe sections for offshore well drilling operations. The connector comprises a first main tube element having as an extension a male connector element provided with a male flange pierced by at least one orifice wherein an auxiliary tube element is secured, and a second main tube element having as an extension a female connector element provided with a female flange pierced by at least one orifice wherein a second auxiliary tube element is secured. The male connector element fits into the female connector element so as to connect the two main tube elements and the two auxiliary tube elements. The connector is characterized in that a locking ring assembles the male flange and the female flange, the locking ring being mounted mobile in rotation on the outer surface of the male flange and the locking ring cooperating with the outer surfaces of the male and female flanges.

According to the invention, the locking ring can be locked in translation by an axial shoulder provided on the male flange, and the ring can be provided with tenons that cooperate with the tenons arranged on the outer surface of the female flange.

The tenons of the locking ring can be arranged on the inner surface of the ring.

The ring can have a cylindrical surface portion that cooperates with a cylindrical surface portion located on the periphery of the male flange.

The ring can comprise teeth that cooperate with teeth arranged on the outer surface of the male flange so as to lock the ring in translation with respect to the male flange and to allow the ring to be dismounted.

The ring can comprise at least one removable pin cooperating with a tooth of the ring so as to lock the locking ring in translation with respect to the male flange.

The male connector element can have as an extension an intermediate part that cooperates with the female connector element.

Each auxiliary tube element can be mounted axially abutted against a shoulder provided in the orifices.

The locking ring can comprise operating means for moving the ring in rotation.

The connector can comprise thrusts for limiting the rotation of the locking ring between an open position and a closed position, and immobilization means for locking the ring in rotation at least in the open position and in the closed position.

At least one of the elements selected from the group consisting of a main tube element and of an auxiliary line element can comprise a steel tube hooped by composite strips. Said composite strips can comprise glass, carbon or aramid fibers, coated with a polymer matrix.

At least one of the elements selected from the group consisting of a main tube element and of an auxiliary line element can be made of a material selected from the list consisting of a composite material comprising reinforcing fibers coated with a polymer matrix, an aluminium alloy, a titanium alloy.

The invention also relates to a riser pipe comprising at least two riser pipe sections assembled by a connector according to the invention, wherein the longitudinal tensional stresses are distributed among the main tube element and the auxiliary tube element.

BRIEF DESCRIPTION OF THE FIGURES

Other features and advantages of the invention will be clear from reading the description hereafter, with reference to the accompanying figures wherein.

DETAILED DESCRIPTION

Figure 1:
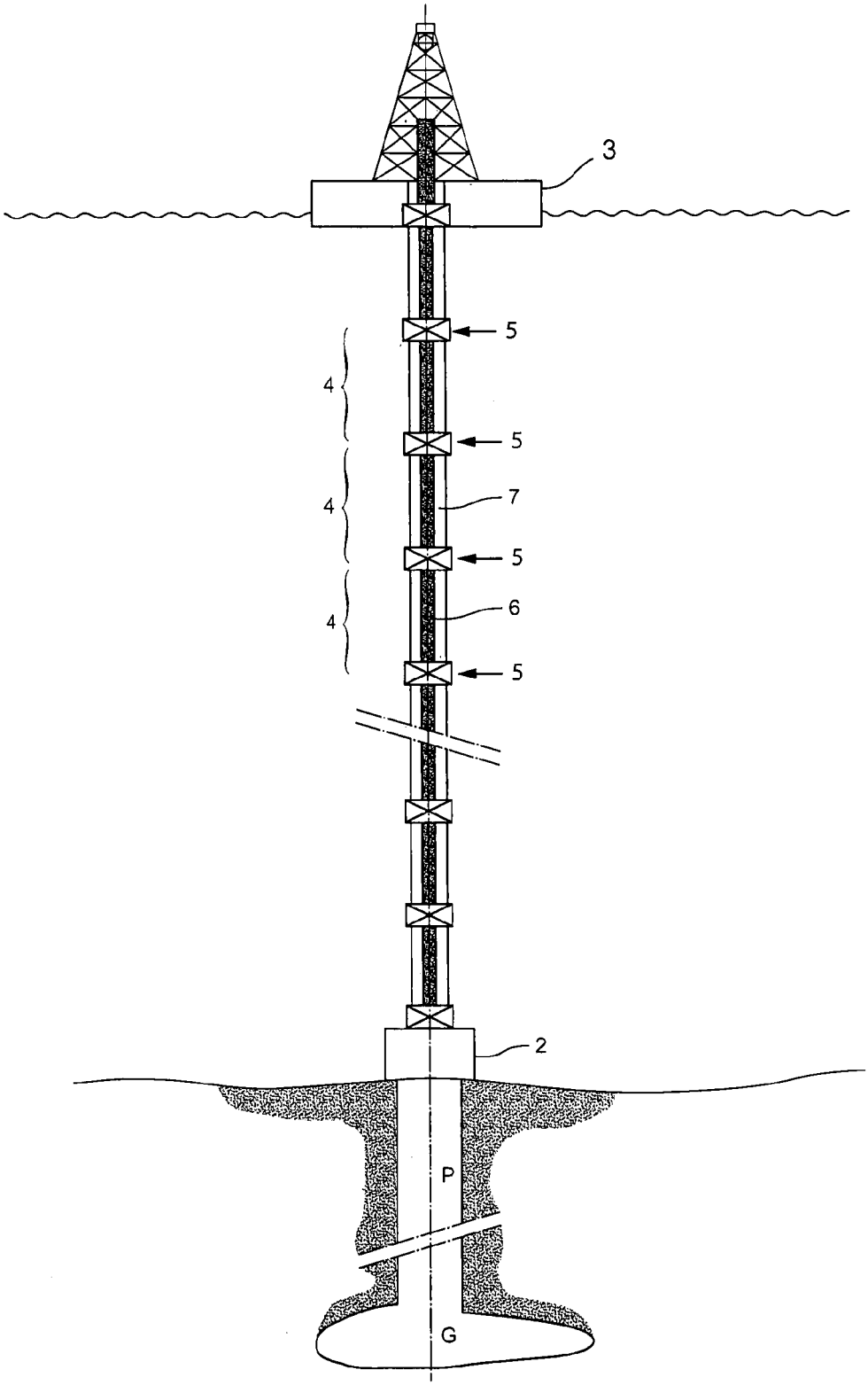
FIG. 1 diagrammatically shows a riser pipe.

FIG. 1 diagrammatically shows a riser pipe 1 installed offshore in order to develop a reservoir G. Riser 1 forms an extension of well P and it extends from wellhead 2 to floater 3, a platform or a vessel for example. Wellhead 2 is provided with a preventer commonly referred to as "B.O.P." or "Blow-Out Preventer". The riser is made up of an assembly of several sections 4 assembled end to end by connectors 5. Each section consists of a main tube element 6 provided with at least one peripheral line element 7. The auxiliary lines referred to as kill lines or choke lines are used to provide well safety during control procedures relative to the inflow of fluids under pressure in the well. The line referred to as booster line allows mud to be injected into the main tube at the foot of the riser. The line referred to as hydraulic line allows a hydraulic fluid to be injected so as to control the blow-out preventer of the wellhead.

Figure 2:
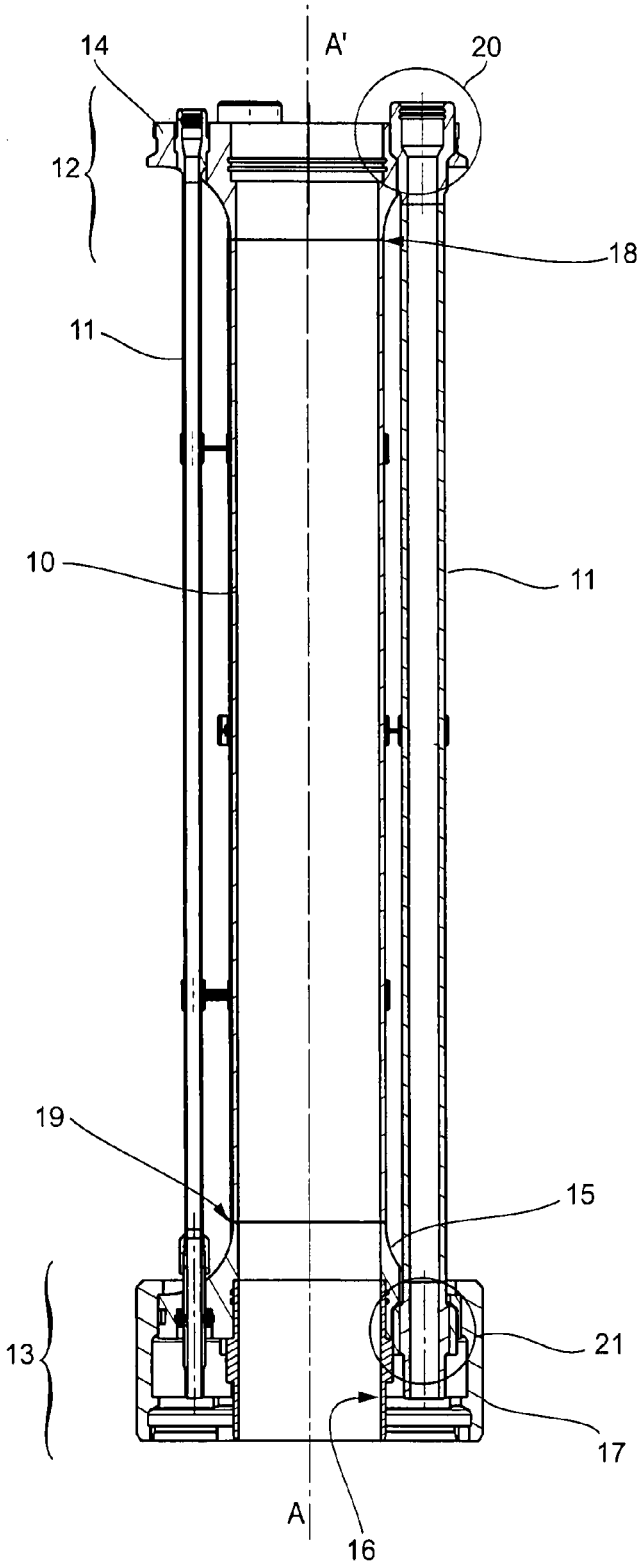
FIG. 2 shows a riser pipe section according to the invention.

FIG. 2 diagrammatically shows a section 4 of the riser pipe. The section comprises a main tube element 10 whose axis AA' is the axis of the riser. Tubes 11 make up auxiliary lines or ducts arranged parallel to axis AA'. Elements 11 have lengths substantially equal to the length of main tube element 10, generally ranging between 10 and 30 meters. There is at least one line 11 arranged on the periphery of the main tube. In FIG. 2, two lines 11 are diagrammatically shown.

Figure 5:
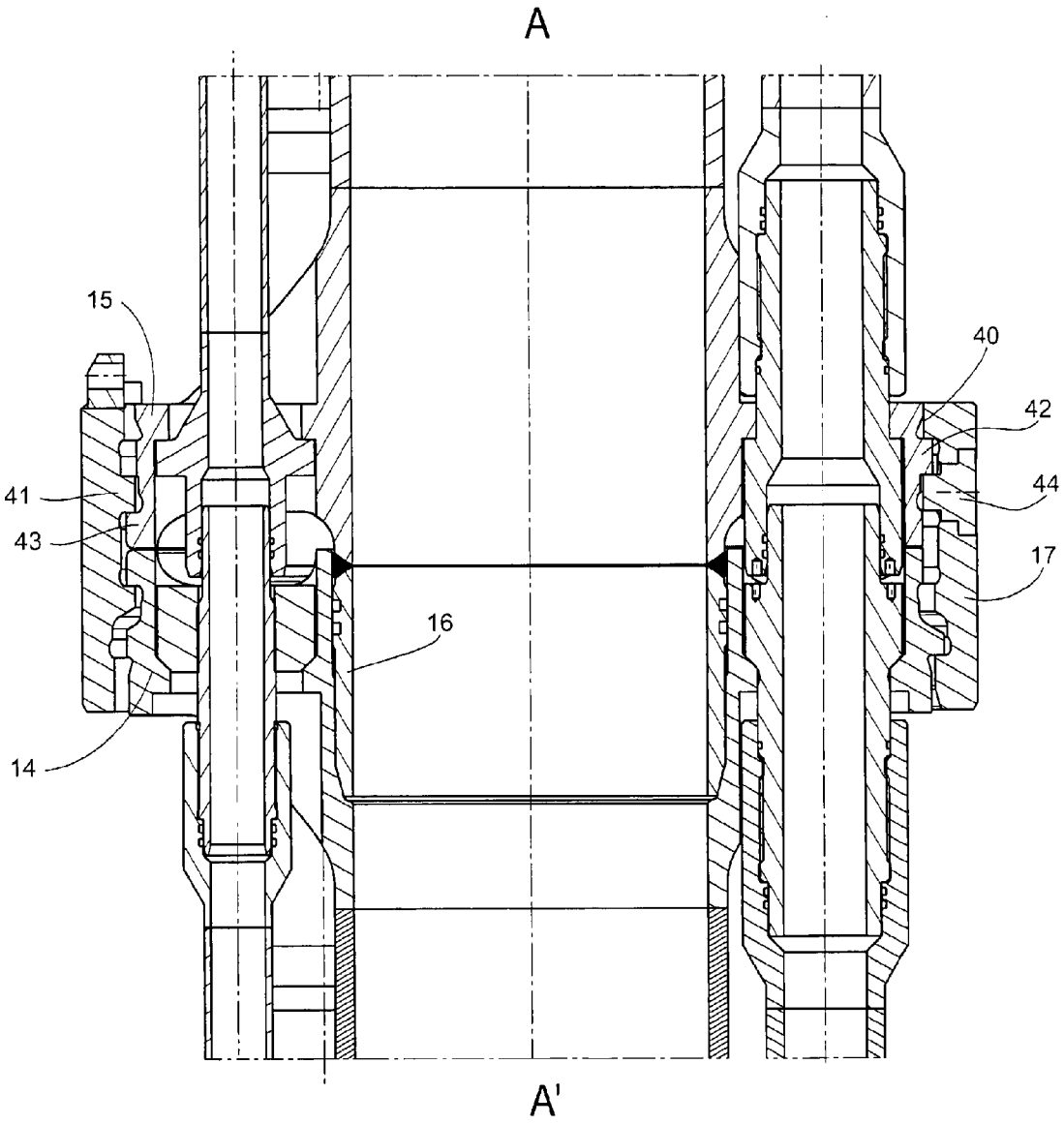

A connector 5 shown in FIG. 1 consists of two elements designated, with reference to FIG. 2, by female connector element 12 and male connector element 13. Elements 12 and 13 are mounted at the ends of main tube element 10. Female connector element 12 consists of a flange 14. Male connector element 13 consists of a flange 15 and of a male element 16. Part 16 can be secured to flange 15 by a means that is not shown. Alternatively to the representation of 15 and 16 in FIGS. 2 and 3, flange 15 and element 16 can make up a single part as shown in FIG. 5. With reference to FIG. 2, female connector element 12 is secured to tube 10, for example by welding 18, by screwing, by crimping or by clamping linkage. Male connector element 13 is secured to tube 10, for example by welding 19, by screwing, by crimping or by clamping linkage. Locking ring 17 allows male connector element 13 and female connector element 12 to be assembled. Elements 12 and 13 and ring 17 form connector 5 that transmits stresses from one riser section to the next section, notably the longitudinal stresses, i.e. the tensional stresses along axis AA' undergone by the riser.

Connector 5 can be designed and dimensioned so as to meet the specifications defined by the American Petroleum Institute standards, notably the API 16 R, API 16 F, API 16 Q and API 2 RD standards.

Figure 3:
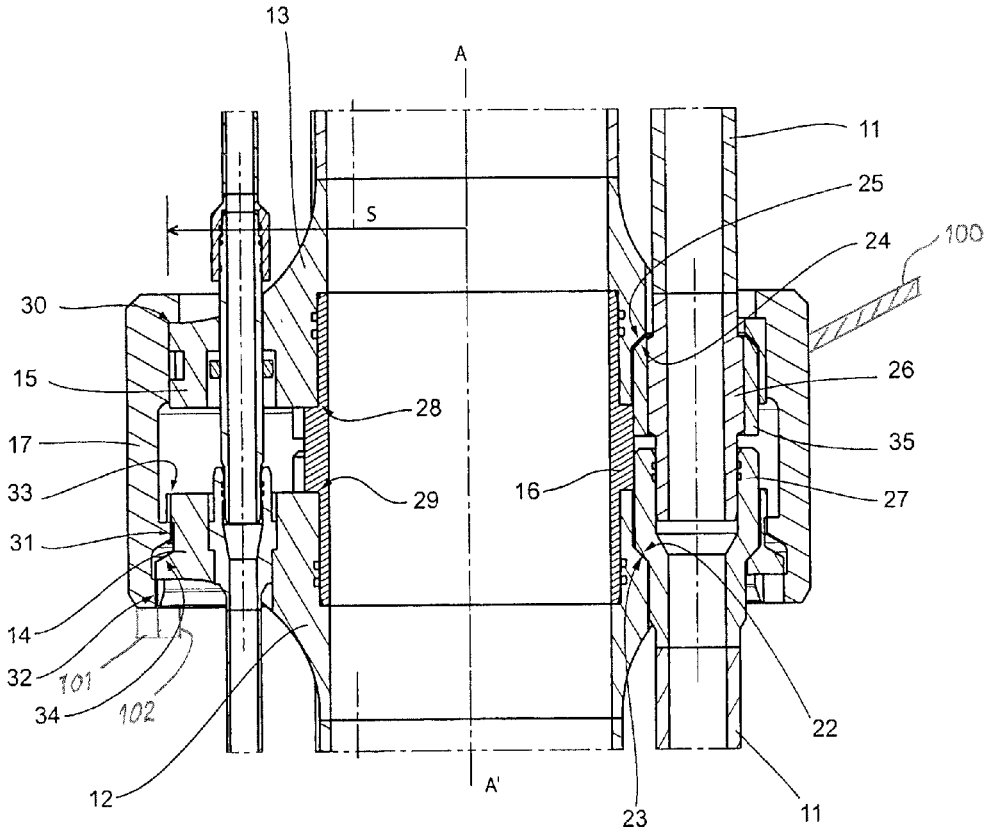
FIGS. 3, 5 and 8 show each a connector according to the invention in locked position.

FIG. 3 shows a male tubular element 13 fitted in female tubular element 12. A portion of male element part 16 penetrates inside female tubular element 12. This fitting is limited by axial thrusts 28 and 29 of male element 16 that abut against flange 15 and flange 14 respectively.

Connector 5 comprises a locking ring 17 positioned on the outer surface of flanges 14 and 15. Ring 17 can be machined in a tube portion or obtained by forging. Ring 17 is provided, at each end thereof, with thrusts that cooperate with flanges 14 and 15 respectively so as to lock in translation along axis AA' flanges 14 and 15. Locking ring 17 is mounted mobile in rotation on flange 15 while being locked in translation in the direction of axis AA'. With reference to FIG. 3, ring 17 comprises at least a cylindrical inner surface portion of radius S and the outer peripheral surface of flange 15 is cylindrical, with a radius slightly smaller than S. Ring 17 is mounted on flange 15 by centering the inner cylindrical surface of the ring on the outer cylindrical surface of flange 15. The ring also rests on axial shoulder 30 provided on flange 15. The inner surface of ring 17 comprises tenons. Flange 14 also comprises tenons arranged on the outer peripheral surface thereof. When element 13 fits into female element 12, part of ring 17 covers flange 14 so that tenons 31 and 32 of ring 17 can cooperate with tenons 33 and 34 of flange 14. Locking and unlocking of connector 5 is achieved through rotation of ring 17 (bayonet type locking). Ring 17 is provided with an operating means, for example an operating bar 100 that can be removable. The operating bar 100 allows to rotate ring 17 around flanges 14 and 15, about axis AA'. Ring 17 can comprise locking means 101, 102 that allow the ring to be locked in rotation in an open position and in a closed position. Furthermore, ring 17 can comprise means, not shown, for limiting the rotation of the ring in these positions. The longitudinal stresses, i.e. the tensional stresses applied along axis AA', are transmitted from a section 4 to adjacent section 4 through the agency of the bayonet type connection between ring 17 and flanges 14 and 15. More precisely, the tensional stresses exerted along axis AA' are transmitted from a riser section to another by the connector as follows: the tensional stresses are transmitted by flange 15 to ring 17 through shoulder 30, then ring 17 transmits the tensional stresses to flange 14 of the adjacent section via the tenons of ring 17 that cooperate with the tenons of flange 14.

Figure 4:
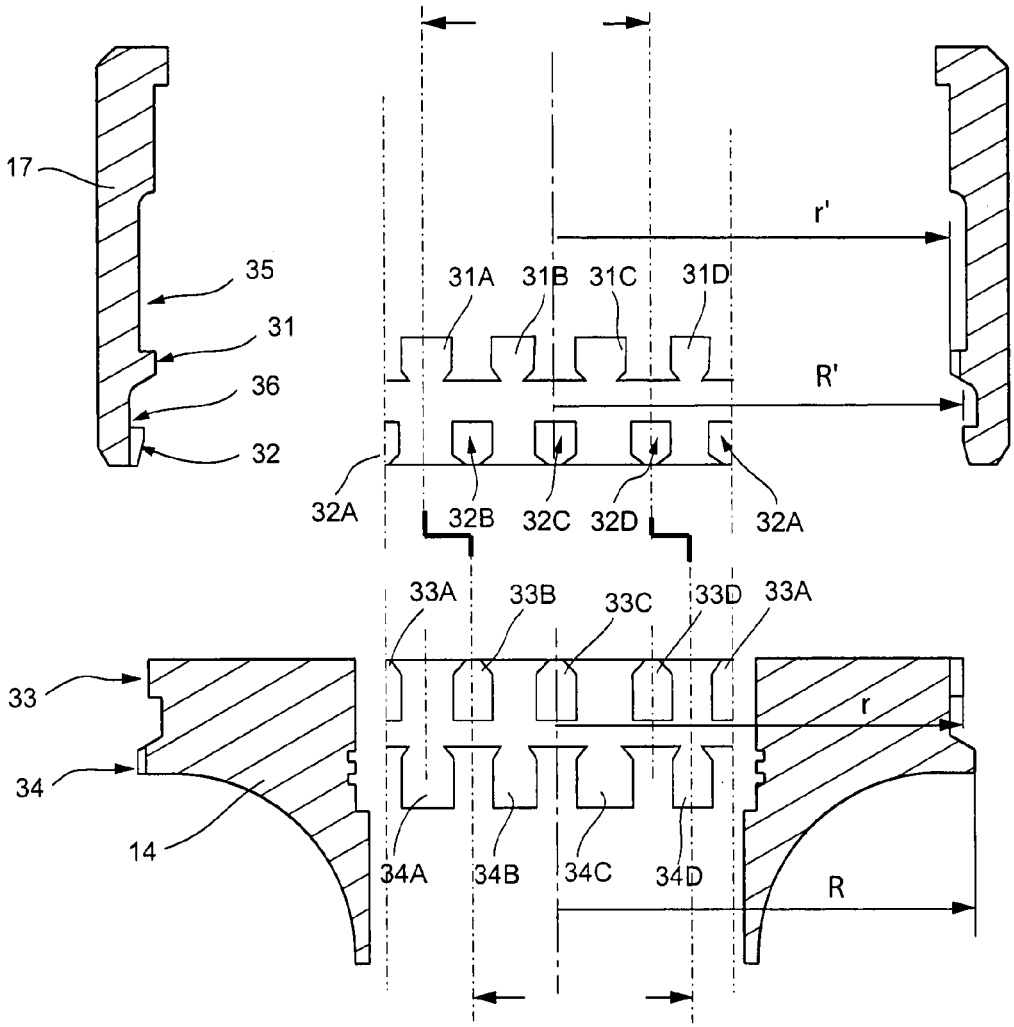
FIG. 4 shows the details of a locking ring of the connector shown in FIG. 3.

With reference to FIG. 3, ring 17 and female element 14 respectively comprise two crowns of tenons or studs 31 and 32, and 33 and 34, allowing to ensure axial locking of the connector. The tenons preferably extend in radial directions. In FIG. 4, female element 14 comprises a first crown 33 of four tenons 33A, 33B, 33C and 33D, and a second crown 34 of four tenons 34A, 34B, 34C and 34D. Ring 17 also comprises a first crown 31 of four tenons 31A, 31B, 31C and 31D, and a second crown 32 of four tenons 32A, 32B, 32C and 32D.

The tenons exhibit an angular offset from one crown to the next and they are inscribed in cylindrical surfaces of different radii. The first and the second crown of female element 14 are respectively inscribed in the cylindrical surfaces of radius r and R. The first and the second crown of ring 17 are respectively inscribed in the cylindrical surfaces of radius r' and R'. Radius r is slightly smaller than radius R' so that tenons 32A to 32D of the second crown of ring 17 can slide and rotate freely within the cylinder formed by the inner surface of tenons 33A to 33D of first crown 33 of flange 14.

Alternatively, the tenons of the two crowns are arranged on the same angular sectors and they are therefore not offset. In this case, the two crowns of tenons of the ring can be inscribed in the same cylindrical surface of radius r1 . The two crowns of tenons of female element 14 are inscribed in the same cylindrical surface of radius r2 greater than r1.

Tenons 31A, 31B, 31C and 31D of the first crown of ring 17 cooperate with tenons 33A, 33B, 33C and 33D of the first crown of flange 14 so as to form a bayonet assembly. Simultaneously, tenons 32A 32B, 32C and 32D of the second crown of ring 17 cooperate with tenons 34A 34B, 34C and 34D of the second crown of flange 14.

More precisely, when ring 17 fits around flange 14, the assembly made up of ring 17, flange 15 and male part 16 performs a translational motion in the direction of axis AA' according to the successive stages as follows:

second crown 32 of the ring moves outside crown 33 of flange 14, then tenons 32 fit between tenons 34 and, simultaneously, tenons 31 fit between tenons 33, then when male part 16 abuts against shoulder 29 of female element 12, tenons 33A, 33B, 33C and 33D lodge in space 35 provided above the first crown of tenons 31 of ring 17, and tenons 34A, 34B, 34C and 34D lodge in space 36 provided between the first crown of tenons 31 and the second crown of tenons 32 of ring 17.

Then, when male part 16 abuts against axial shoulder 29 of female element 12, ring 17 is pivoted so that the tenons of the ring are positioned opposite the tenons of flange 14. The tenons of crown 31 are positioned opposite the tenons of crown 33 and the tenons of crown 32 are positioned opposite the tenons of crown 34. Thus, the tenons of ring 17 are axially abutted (with a play of about 3 mm that is cancelled out when the connector is under load) with respect to the tenons of flange 14 and they lock in translation flange 14 with respect to flange 15.

Each one of the two bayonet assembly systems can allow to provide, between the tenons of flange 14 and the tenons of ring 17, contact over a total angular range that can reach 175°. Preferably, the two assembly systems being angularly offset around the connector axis, the connector according to the invention allows the axial loads to be distributed over about 350° around the axis.

Alternatively, according to the invention, ring 17 and flange 14 may comprise only one crown of tenons each: the tenons of the single crown of ring 17 cooperate with the tenons of the single crown of flange 14.

The number of tenons per crown and their geometry can vary, notably depending on the dimensions of the main tube, on the number and on the dimensions of the auxiliary lines and on the stresses to be transmitted by the connector.

A locking system allows ring 17 to be locked in rotation.

FIG. 5 shows an alternative embodiment of the connector according to the invention. The reference numbers of FIG. 5 identical to those of FIG. 3 designate the same elements.

FIG. 5 shows the male element of the connector consisting of part 16 welded onto flange 15, the male element being fitted in the female element consisting of flange 14. The connector comprises means for assembling ring 17 on flange 15 so as to readily mount and dismount ring 17 on the connector. More precisely, ring 17 is provided with a set of teeth 40 and 41 that cooperates with a set of teeth 42 and 43 arranged on the outer surface of flange 15. One or more pins 44 allow the assembly of ring 17 on flange 15 to be locked. Preferably, the ring is provided with at least two pins, or even at least three pins, in order to prevent jamming of ring 17 on flange 15. An excellent configuration consists in arranging a pin between each tooth of the series of teeth 40 shown in detail in FIG. 6.

Figure 6:
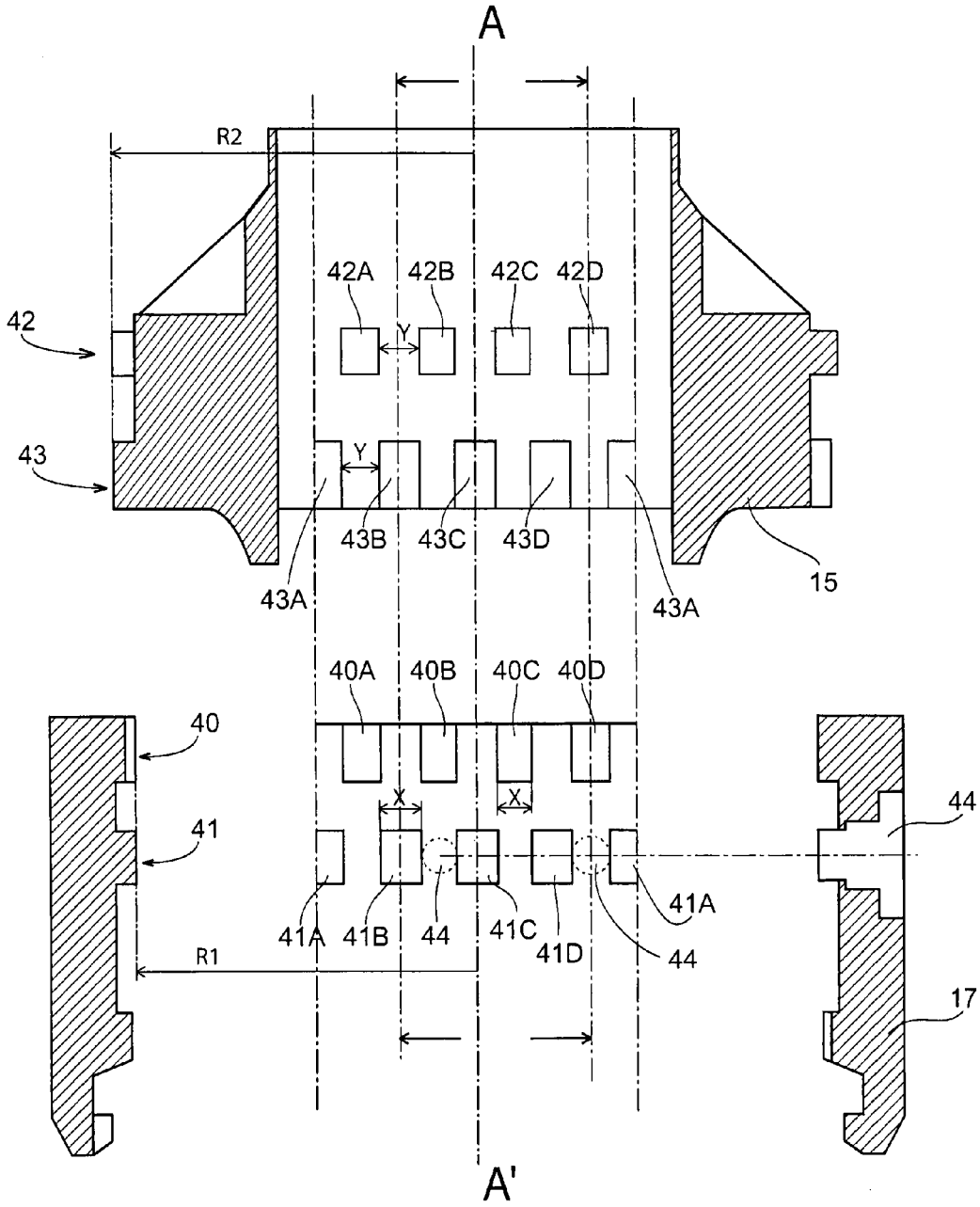
FIG. 6 shows the details of a locking ring of the connector shown in FIG. 5, FIGS. 7 and 9 show two other embodiments of the assembly of the auxiliary lines and of the main tube.

FIG. 6 is a cross-sectional view of ring 17 and of flange 15, and a developed view of series of teeth 40, 41, 42 and 43. With reference to FIG. 6, ring 17 comprises a first series 40 of four teeth 40A, 40B, 40C and 40D, and a second series 41 of four teeth 41A, 41B, 41C and 41D. Flange 15 comprises a first series 42 of four teeth 42A, 42B, 42C and 42D, and a second series 43 of four teeth 43A 43B, 43C and 43D. The number of teeth per series can range between 2 and 8 teeth per series for example. The number of series of teeth can be reduced to 1 or increased, for example to 3 or 4 series per element 15 and 17.

For each element made up of ring 17 and flange 15, the teeth are angularly offset from one series to the next and they are inscribed in cylindrical surfaces of same radius. The first and second series of teeth 40 and 41 are inscribed in a cylinder of radius R1. The first and second series of teeth 42 and 43 are inscribed in a cylinder of radius R2 greater than radius R1. Alternatively, series of teeth 40, 41, 42 and 43 can be inscribed in cylinders of different radii according to a configuration similar to that of tenons 31, 32, 33 and 34, as described above.

Teeth 40A, 40B, 40C and 40D of the first series of teeth of ring 17 cooperate with teeth 42A, 42B, 42C and 42D of the first series of teeth of flange 15 so as to form a bayonet assembly. Simultaneously, teeth 41A, 41B, 41C and 41D of the second series of teeth of ring 17 cooperate with teeth 43A, 43B, 43C and 43D of the second series of teeth of flange 15 so as to form a bayonet assembly. Each pin 44 is mounted in a hole provided through ring 17 between two teeth of the second series of teeth 41. The hole and pin 44 can be cylindrical.

Ring 17 can be mounted on flange 15 by carrying out the following successive stages:

engaging ring 17 around flange 15 by translation of ring 17 along axis AA' so that teeth 40 fit between teeth 43 until teeth 40 are in contact with teeth 42, then pivoting ring 17, then translating ring 17 along axis AA' so that teeth 40 fit between teeth 42 and teeth 41 fit between teeth 43 until teeth 41 are in contact with teeth 42, inserting pin(s) 44 into their housing in ring 17.

Thus, axial immobilization of ring 17 on flange 15 is provided, on the one hand, by pin(s) 44 abutted against teeth 43 that prevent descending translation of the ring along axis AA' (pins 44 can abutted with teeth 43B and 43D in FIG. 6) and, on the other hand, by teeth 41 opposite teeth 42 that prevent any ascending translation of ring 17 along axis AA' that might occur through collision of the ring with another part, notably within the context of the connector assembling operation.

Preferably, teeth 40 and 41 for mounting ring 17, respectively teeth 42 and 43 of flange 15, are the same number and they are positioned opposite tenons 31 and 32 for locking ring 17, respectively tenons 33 and 34 of flange 14, in such a way that, when the connector is in locked mode, i.e. closed, the loads pass on the one hand through teeth 40 and 41 and, on the other hand, through tenons 31 and 32, and not through pins 44. The pins are involved when the connector is in "non-locked" mode to support the weight of ring 17. Thus, when the connector is locked, ring 17 is pivoted so that teeth 40, respectively teeth 41, rest on teeth 42, respectively 43, and simultaneously the tenons of crown 31 are positioned opposite the tenons of crown 33, and the tenons of crown 32 are positioned opposite the tenons of crown 34. In the connector in locked position, ring 17 is locked in translation in a direction of axis AA' by teeth 40 and 41 respectively in contact with teeth 42 and 43 of flange 15. Ring 17 is locked in translation in the other direction of axis AA' by the tenons of crown 31 positioned opposite the tenons of crown 33 and the tenons of crown 32 positioned opposite the tenons of crown 34.

Ring 17 according to the embodiment of FIGS. 5 and 6 can be readily dismounted in order to be subjected to in-service inspection and control operations. In order to dismount the ring, width X of the teeth of ring 17 is smaller than width Y between two teeth of flange 15. Widths X and Y are respectively measured on the periphery of ring 17 and of flange 15, on a circle centered on axis AA' and inscribed in a plane perpendicular to axis AA'.

Ring 17 can be dismounted from flange 15 by carrying out the following successive stages:

removing pin(s) 44 from ring 17, then pivoting ring 17 and translating it along axis AA' so that teeth 40 pass between teeth 42 and teeth 41 pass between teeth 43, until teeth 40 come into contact with teeth 43, then pivoting ring 17 and translating it along axis AA' so that teeth 40 pass between teeth 43 until ring 17 is released from flange 15.

Auxiliary line element 11 is secured, at each end thereof, to main tube 10. In other words, riser section 1 comprises at each end thereof fastening means 20 and 21, diagrammatically shown in FIG. 2, allowing an auxiliary line element 11 to be axially linked to main tube 10. According to the invention, means 20 and 21 allow longitudinal stresses to be transmitted from main tube 10 to elements 11. Thus, these fastening means 20 and 21 allow the tensional stresses applied to each section of the riser pipe to be distributed among main tube 10 and auxiliary line elements 11.

With reference to FIG. 3, at the level of the section end provided with female connector means 12, main tube 10 has as an extension shoulder or flange 14 comprising a cylindrical passage wherein auxiliary line element 11 can slide. Auxiliary tube element 11 comprises a thrust 22, a nut or a shoulder for example, intended to position element 11 axially with respect to flange 14. When mounting element 11 on main tube 10, thrust 22 of element 11 rests against flange 14, for example against axial shoulder 23 provided in the cylindrical passage so as to form a rigid link.

At the level of the section end provided with male connector means 13, main tube 10 has as an extension shoulder or flange 15 comprising a cylindrical passage wherein auxiliary line element 11 can slide. Auxiliary line element 11 comprises a thrust 24, a nut or a shoulder for example, intended to position element 11 axially with respect to flange 15. When mounting element 11 on main tube 10, thrust 24 of element 11 rests against flange 15, for example against axial shoulder 25 provided in the cylindrical passage so as to form a rigid link.

Flanges 14 and 15 have shapes of revolution around axis AA', except for the teeth arranged on the periphery of flange 14. Flanges 14 and 15 form an extension of main tube elements 10 while increasing the thickness and the outer section of the tube, so as to form shoulders respectively. Preferably, the outer section of flanges 14 and 15 varies progressively along axis AA' so as to avoid a sudden section variation between tube 10 and the shoulders that would weaken the mechanical strength of connector 5.

Fastening means 20 consisting of thrusts 22 and 23 allow to lock the axial translations of an element 11 in a direction with respect to main tube 10. Fastening means 21 consisting of thrusts 24 and 25 allow to lock the axial translations of an element 11 in the opposite direction with respect to the main tube. The combination of fastening means 20 and of fastening means 21 allows element 11 to be completely secured with respect to main tube element 10. Thus, elements 11 are involved, together with main tube element 10, in the taking up of the longitudinal stresses undergone by pipe 1.

The shape and in particular the thickness of flanges 14 and 15 are determined so as to withstand the longitudinal stresses transmitted to auxiliary line elements 11.

Auxiliary line elements 11 are connected end to end by means of connections. A connection is made up of a male end part 26 arranged at one end of element 11 and of a female end part 27 arranged at the other end of element 11. A male end part 26 cooperates tightly with female end part 27 of another element 11. For example, male element 26 of the connection is a tubular part that fits into another tubular part 27. The inner surface of female end part 27 is adjusted to the outer surface of male end part 26. Joints are mounted in slots machined on the inner surface of female element 27 so as to provide a tight link. The connection allows axial displacement of one of elements 11 with respect to the other, while maintaining the tight link between the two elements. Tube elements 11 can be provided with a device for adjusting length differences between main tube 10 and tube elements 11 due to manufacturing tolerances. For example, nut 35 is screwed onto end part 26 so as to adjust the position of thrust 24 with respect to thrust 25.

Figure 7:
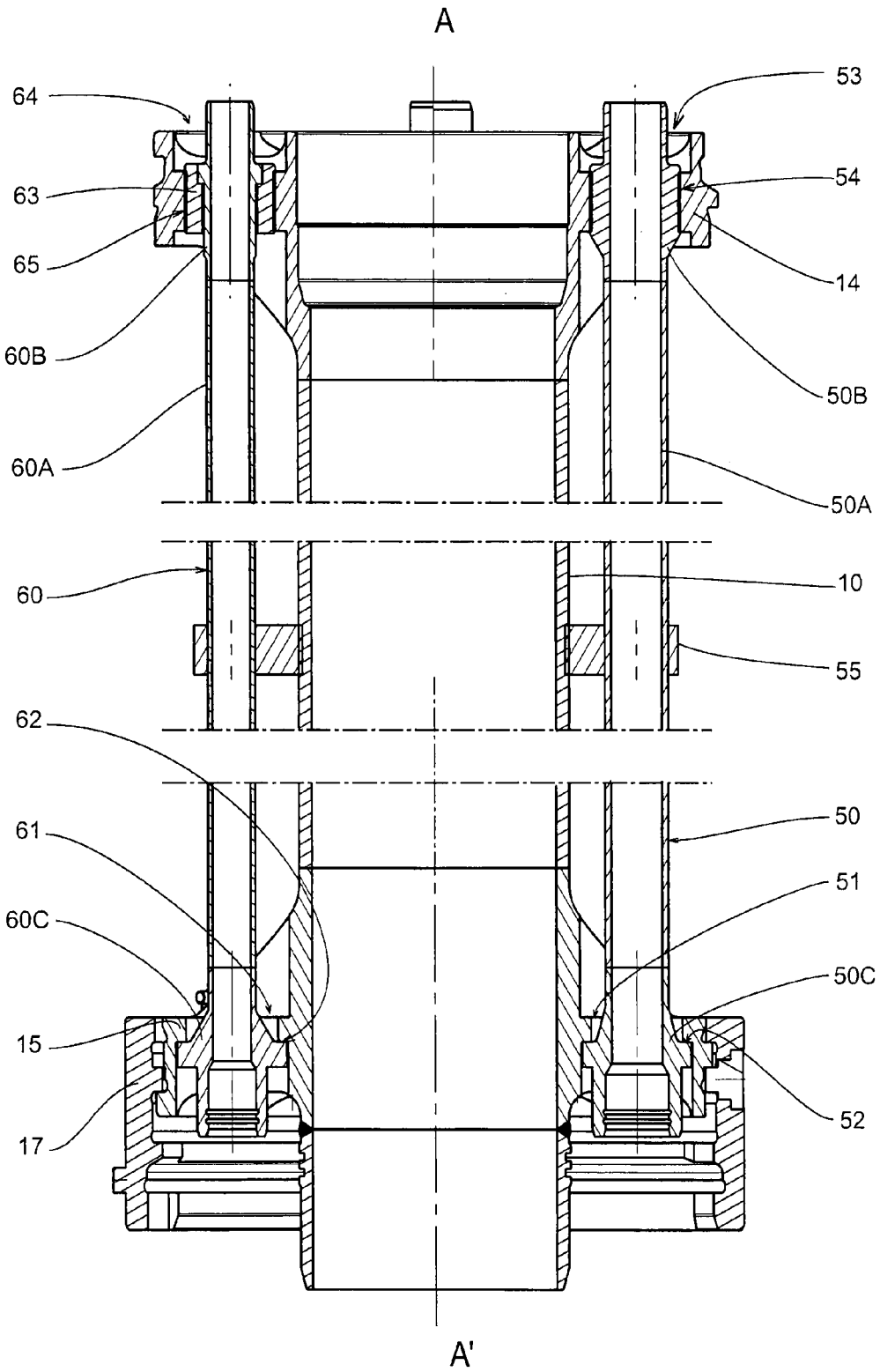
Figure 8:
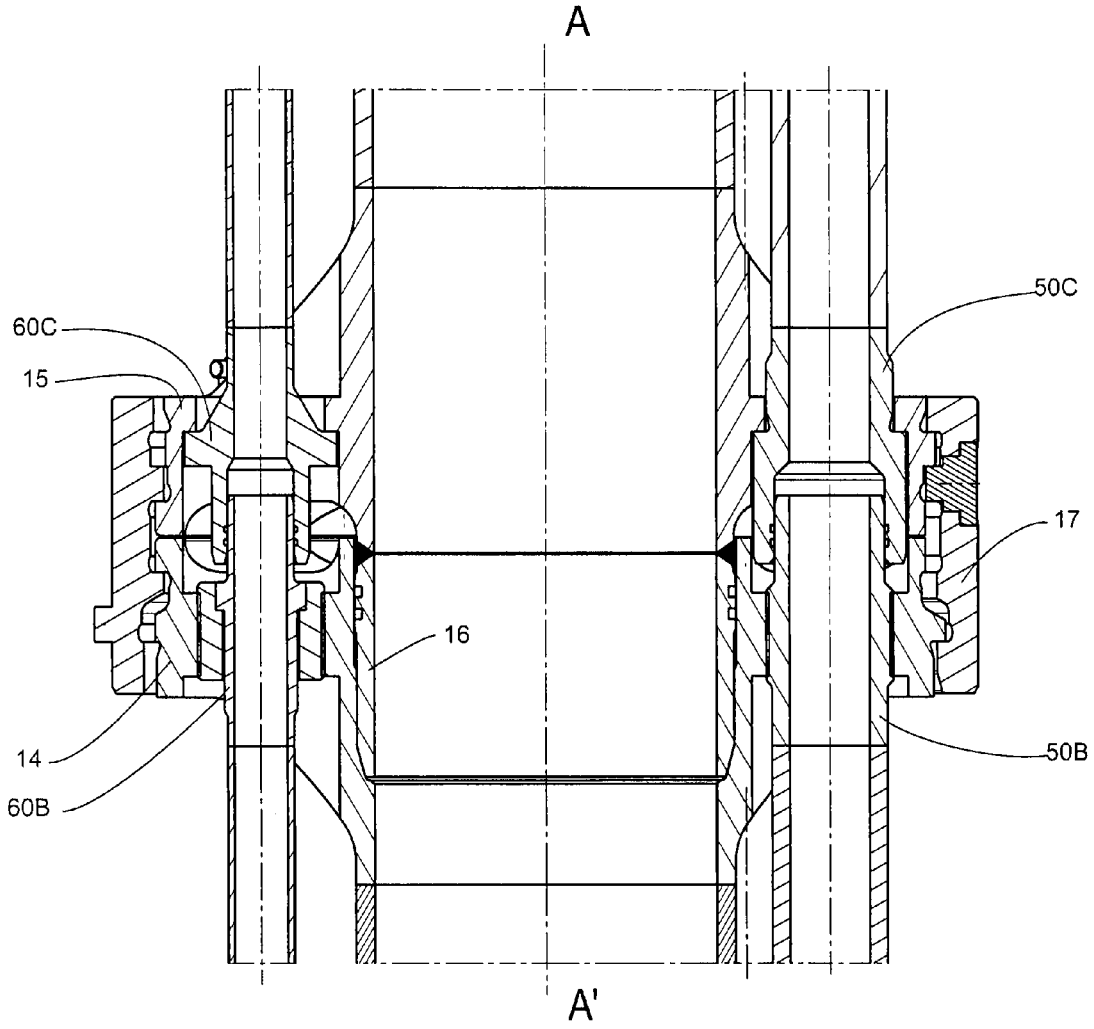

FIG. 7 is a cross-sectional view of a riser section provided with a connector according to the invention. FIG. 8 is a cross-sectional view of a connector according to FIG. 7 in locked position. The reference numbers of FIGS. 7 and 8 identical to those of FIG. 2 designate the same elements.

With reference to FIGS. 7 and 8, auxiliary line element 50 is secured at both ends to main tube 10 via flanges 14 and 15. Element 50 consists of a tube 50A provided at its ends with a female part 50C and a male connection part 50B. Parts 50B and 500 can be welded onto tube 50A. Part 50B is suited to fit into part 500 so as to form a tight link. Receptacle part 500 is mounted in passage 51 provided through flange 15 so that element 50 rests against thrust 52 of flange 15. Thrust 52 can be plane to provide freedom of lateral displacement for part 50C in order to facilitate auxiliary line connection operations. Part 50B is provided with a thread on the outer surface thereof that cooperates with thread 54 provided in passage 53 in flange 14. Thus, connection part 50B is mounted in passage 53 by screwing.

In order to mount tube element 50 on the riser section, element 50 is fed through passage 52 with part 50B forward. Then, part 50B of element 50 is screwed into passage 53 of flange 14 until the shoulder of element 50C abuts against thrust 52 of flange 15. Element 50 is then immobilized in rotation with respect to tube 10 by fastening means 55, collars for example.

Auxiliary line element 60 is secured at both ends to main tube 10 via flanges 14 and 15. Element 60 consists of a tube 60A provided at its ends with a female part 60C and a male connection part 60B. Parts 60B and 60C can be welded onto tube 60A. Part 60B is suited to fit into part 600 so as to form a tight link. Female part 600 is mounted in passage 61 provided through flange 15 so that element 60 rests against thrust 62 of flange 15. Part 60B is secured to a nut 63 by a thrust and shoulder system. The outer surface of nut 63 is threaded. Nut 63 cooperates with thread 65 provided in passage 64 in flange 14. Thus, connection part 60B is mounted in passage 64 by screwing nut 63.

In order to mount tube element 60 on the riser section, element 60 is fed through passage 61 with part 60B provided with nut 63 forward. Then, nut 63 of element 60 is screwed into passage 64 of flange 14 until the shoulder of element 600 abuts against thrust 62 of flange 15. Element 60 is then immobilized in rotation with respect to tube 10 by fastening means 55, collars for example.

Figure 9:
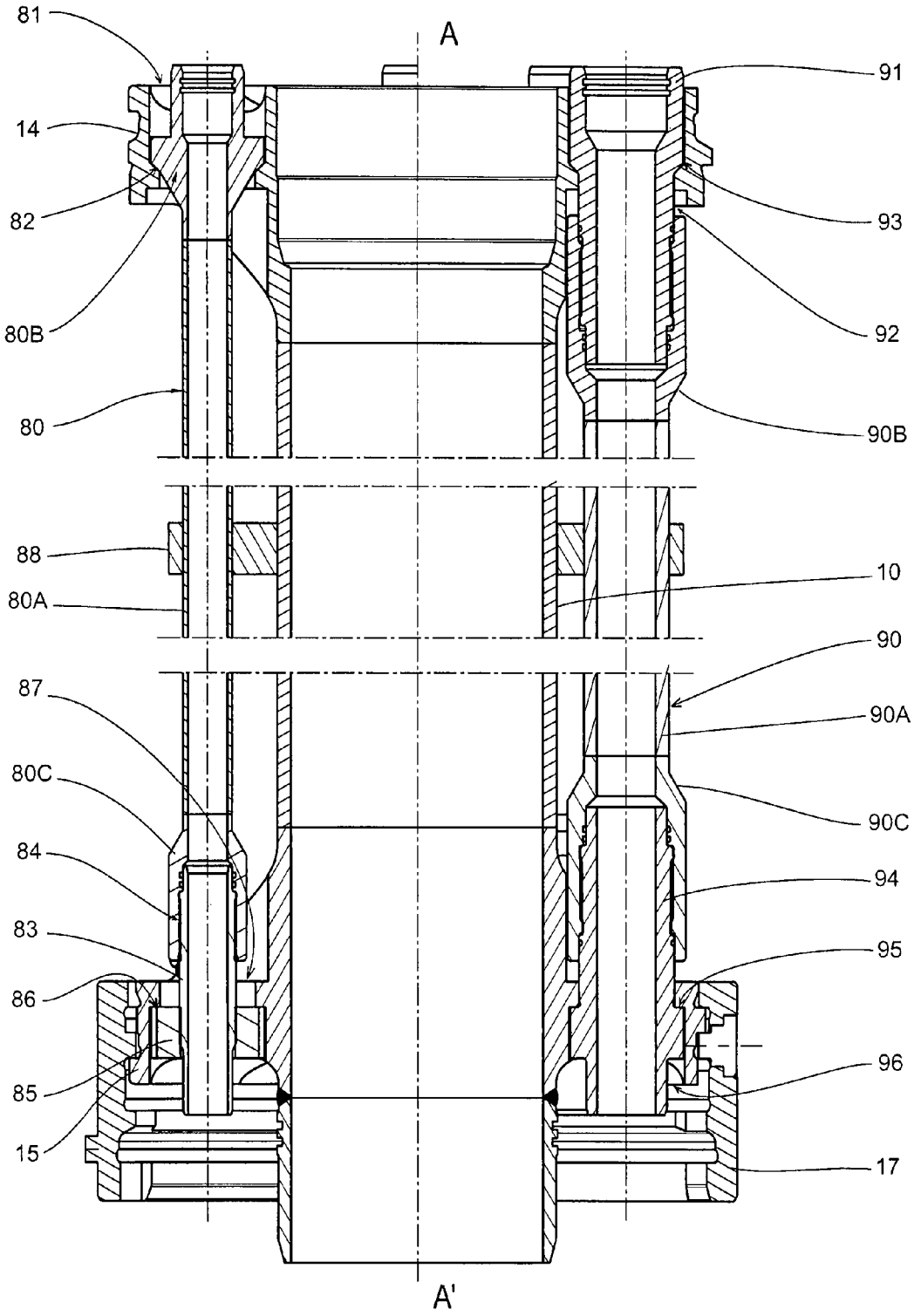

FIG. 9 is a cross-sectional view of a riser section provided with a connector according to the invention. The reference numbers of FIG. 9 identical to those of FIG. 2 designate the same elements.

With reference to FIG. 9, auxiliary line element 80 is secured at both ends to main tube 10 via flanges 14 and 15. Element 80 consists of a tube 80A provided at its ends with a female part 80B and a receptacle part 800. Parts 80B and 80C can be welded onto tube 80A. Parts 80B and 80C cooperate with tubular end part 83 to form tight links. Female part 80B is mounted in passage 81 provided through flange 14 so that element 80 rests against thrust 82 of flange 14. Receptacle part 80C is provided with a thread on the inner surface thereof that cooperates with thread 84 provided in part of end part 83. Another part of end part 83 comprises a thread into which is screwed nut 85 that cooperates with a thrust 86 formed in passage 87 provided in flange 15. Thrust 86 can be plane so as to provide freedom of lateral displacement for parts 83 and 85 to facilitate auxiliary line connection operations.

In order to mount tube element 80 on the riser section, element 80 provided with end part 83 is fed through passage 81. Then, nut 85 is screwed onto end part 83 until part 80 rests against thrust 82 and nut 85 abuts against shoulder 86. Element 80 is then immobilized in rotation with respect to tube 10 by fastening means 88, collars for example.

Auxiliary line element 90 is secured at both ends to main tube 10 via flanges 14 and 15. Element 90 consists of a tube 90A provided at its ends with a female receptacle part 90B and a female receptacle part 90C. Parts 90B and 90C can be welded onto tube 90A. Receptacle part 90B cooperates with tubular female end part 91 to form a tight link, Female end part 91 is screwed in receptacle part 90B. End part 91 is mounted in passage 92 provided through flange 14 so that a shoulder of end part 91 rests against thrust 93 of flange 14. Receptacle part 900 cooperates with tubular male end part 94 to form a tight link. Male end part 94 is suited to fit into female end part 91 so as to form a tight link. End part 94 is screwed in receptacle part 90C. End part 94 is mounted in passage 96 provided through flange 15 so that a shoulder of end part 94 rests against thrust 95 of flange 15. Thrust 95 can be plane so as to provide freedom of lateral displacement for part 96 to facilitate auxiliary line connection operations.

In order to mount tube element 90 on the riser section, element 90 is arranged without end parts 91 and 94 between flanges 14 and 15. Then, end part 94 is screwed into receptacle 900 until end part 94 rests against thrust 95 and end part 91 is screwed into receptacle 90B until end part 91 rests against thrust 93. Element 90 is then immobilized in rotation with respect to tube 10 by fastening means 88, collars for example.

Arranging locking ring 17 on the outer periphery of flanges 14 and 15 allows a more compact layout of the elements of auxiliary tube 11 and of main tube 10. It is consequently possible to limit the spacing of elements 11 and of main tube 10 with respect to ring 17. Therefore, reducing the distance between elements 11 and ring 17 and between tube 10 and ring 17 allows to minimize the bending stresses undergone by flanges 14 and 15.

Furthermore, the device according to the invention provides an interesting solution for mounting in a simple and fast way a riser pipe whose tensional stresses are distributed among the auxiliary tube elements and the main tube. In fact, although auxiliary tube elements 11 and main tube element 10 are mounted so as to jointly endure the tensional stresses undergone by the pipe, connecting a riser pipe section to another riser pipe section is achieved in a single operation by rotating ring 17. This connection allows to communicate and to seal the main tube element of a section with the element of the other section, and to simultaneously communicate and seal the auxiliary line elements of one of the sections with those of the other section.

The following operations can be carried out to achieve connection of the connector according to the invention.

Operation 1

Ring 17 is kept in open position by a locking system.

Male element 13 of a section faces female element 12 of another section. For example, female element 12 is suspended from a handling table and element 13 is operated by hoisting means.

The end of male element 13 consisting of the rear end of element 16 protrudes axially from ring 17 and engages into female element 12. The position of auxiliary line elements 11 allows element 13 to be angularly positioned with respect to element 12.

Operation 2

Male element 13 is slid longitudinally in female element 12 until the two elements fit into and abut against one another.

When element 13 fits into element 12, on the one hand, the tenons of ring 17 slide between the tenons of flange 14 as described above and, on the other hand, male end parts 26 of elements 11 penetrate inside female end parts 27 of elements 11.

Operation 3

When element 13 is completely fitted inside element 12, ring 17 is released in rotation by acting upon the locking system, then ring 17 is pivoted around the connector axis. Rotation of ring 17 is performed until a closed position is reached, i.e. until the tenons of ring 17 are positioned opposite the tenons of flange 14. The locking system can limit rotation of the ring.

When ring 17 is in closed position, the ring is immobilized with respect to flange 14 by acting upon the locking system.

Operation 4

The entire riser pipe thus connected is raised, which has the effect of placing the connector under tension and of taking up the operating clearances: the tenons of crowns 31 and 32 of ring 17 come effectively into contact with the tenons of crowns 33 and 34 of flange 14.

Furthermore, in order to produce risers that can operate at depths reaching 3500 m and more, main tube 10 and/or auxiliary lines 11 can be made with metallic tube elements whose resistance is optimized by composite hoops made of fibers coated with a polymer matrix.

A tube hooping technique can be the technique consisting in winding under tension composite strips around a metallic tubular body, as described in documents FR-2,828,121 (U.S. Pat. No. 6,895,806), FR-2,828,262 (U.S. Pat. No. 6,536,480) and U.S. Pat. No. 4,514,254.

The strips consist of fibers, glass, carbon or aramid fibers for example, the fibers being coated with a polymer matrix, thermoplastic or thermosetting, such as a polyamide.

A technique known as self-hooping can also be used, which consists in creating the hoop stress during hydraulic testing of the tube at a pressure causing the elastic limit in the metallic body to be exceeded. In other words, strips made of a composite material are wound around the tubular metallic body. During the winding operation, the strips induce no stress or only a very low stress in the metallic tube. Then a predetermined pressure is applied within the metallic body so that it deforms plastically. After return to a zero pressure, residual compressive stresses remain in the metallic body and tensile stresses remain in the composite strips.

The thickness of the composite material wound around the metallic tubular body, preferably made of steel, is determined according to the hoop prestress required for the tube to withstand, according to the state of the art, the pressure and tensile stresses.

According to another embodiment, tube elements 10 and/or 11 that make up the main tube and the auxiliary lines can be made of an aluminium alloy. For example, aluminium alloys with ASTM (American Standard for Testing and Material) references 1050, 1100, 2014, 2024, 3003, 5052, 6063, 6082, 5083, 5086, 6061, 6013, 7050, 7075, 7055 or aluminium alloys marketed under reference numbers C405, CU31, C555, CU92, C805, C855, C70H by the ALCOA Company can be used.

Alternatively, tube elements 10 and/or 11 that make up the main tube and the auxiliary lines can be made of a composite material consisting of fibers coated with a polymer matrix. The fibers can be carbon, glass or aramid fibers. The polymer matrix can be a thermoplastic material such as polyethylene, polyamide (notably PA11, PA6, PA6-6 or PA12), polyetheretherketone (PEEK) or polyvinylidene fluoride (PVDF). The polymer matrix can also be made of a thermosetting material such as epoxys.

Alternatively, tube elements 10 and/or 11 that make up the main tube and the auxiliary lines can be made of a titanium alloy. For example, a Ti-6-4 titanium alloy (alloy comprising, in wt. %, at least 85% titanium, about 6% aluminium and 4% vanadium) or the Ti-6-6-2 alloy comprising, in wt. %, about 6% aluminium, 6% vanadium, 2% tin and at least 80% titanium, can be used.

The invention claimed is:

1. A connector for assembling two riser pipe sections for offshore well drilling operations, comprising:

A first main tube element having as an extension a male connector element provided with a male flange, the male flange being pierced by at least one orifice wherein a first auxiliary tube element is secured, a second main tube element having as an extension a female connector element provided with a female flange, the female flange being pierced by at least one other orifice wherein a second auxiliary tube element is secured, the male connector element fitting into the female connector element so as to connect the first main tube element with the second main tube element and to connect the first auxiliary tube element with the second auxiliary tube element, and a locking ring that assembles the male flange and the female flange, the locking ring being mounted mobile in rotation on an outer periphery of the male flange, and the locking ring cooperating with the outer periphery of the male flange and an outer periphery of the female flange.

2. The connector as claimed in claim 1, wherein the locking ring is locked in translation by an axial shoulder provided on the male flange, and the locking ring is provided with tenons that cooperate with tenons arranged on the outer periphery of the female flange.

3. The connector as claimed in claim 1, wherein the locking ring is provided with tenons arranged on an inner surface of the locking ring.

4. The connector as claimed in claim 1, wherein the locking ring has a one cylindrical surface portion that cooperates with another cylindrical surface portion located on the outer periphery of the male flange.

5. The connector as claimed in claim 1, wherein the locking ring comprises teeth that cooperate with teeth arranged on the outer periphery of the male flame so as to lock the locking ring in translation with respect to the male flange and to allow the locking ring to be dismounted.

6. The connector as claimed in claim 5, wherein the locking ring comprises at least one removable pin cooperating with a tooth of the locking ring so as to lock the locking ring in translation with respect to the male flange.

7. The connector as claimed in claim 1, wherein the male connector element has as an extension that cooperates with the female connector element.

8. The connector as claimed in claim 1, the first auxiliary tube element is mounted axially abutted against a shoulder provided in the at least one orifice, and the second auxiliary tube element is mounted axially abutted against another shoulder provided in the at least one other orifice.

9. The connector as claimed in claim 1, wherein the locking ring comprises an operating means for moving the locking ring in rotation.

10. The connector as claimed in claim 1, further comprising thrusts for limiting the rotation of the locking ring between an open position and a closed position, and an immobilization device for locking the locking ring in rotation at least in the open position and in the closed position.

11. The connector as claimed in claim 1, wherein at least one of the first main tube element, the second main tube element, the first auxiliary line element and the second auxiliary line element comprises a steel tube hooped by composite strips.

12. The connector as claimed in claim 11, wherein said composite strips comprise glass, carbon or aramid fibers, coated with a polymer matrix.

13. The connector as claimed in claim 1, wherein at least one of the first main tube element, the second main tube element, the first auxiliary line element and the second auxiliary line element is made of a material selected from the list consisting of reinforcing fibers coated with a polymer matrix, an aluminium alloy, a titanium alloy.

14. A riser pipe comprising at least the first main tube element with the second main tube element assembled by the connector as claimed in claim 1, wherein longitudinal tensional stresses are distributed among the first main tube element, the second main tube element, the first auxiliary line element and the second auxiliary tube element.

* * * * *